US009670775B2

(12) United States Patent
Tjhang et al.

(10) Patent No.: US 9,670,775 B2
(45) Date of Patent: Jun. 6, 2017

(54) METHODS AND SYSTEMS FOR DOWNHOLE FLUID ANALYSIS

(71) Applicants: Schlumberger Technology Corporation, Sugar Land, TX (US); The University of Tokyo, Bunkyo-ku (JP)

(72) Inventors: Theodorus Tjhang, Sagamihara (JP); Masatoshi Ishikawa, Kashiwa (JP)

(73) Assignees: SCHLUMBERGER TECHNOLOGY CORPORATION, Sugar Land, TX (US); THE UNIVERSITY OF TOKYO, Bunkyo-Ku, Tokyo (JP)

( * ) Notice: Subject to any disclaimer, the term of this patent is extended or adjusted under 35 U.S.C. 154(b) by 365 days.

(21) Appl. No.: 14/066,700

(22) Filed: Oct. 30, 2013

(65) Prior Publication Data

US 2015/0114627 A1 Apr. 30, 2015

(51) Int. Cl.

| | |
|---|---|
| ***G06K 9/00*** | (2006.01) |
| ***E21B 49/10*** | (2006.01) |
| *E21B 49/08* | (2006.01) |

(52) U.S. Cl.

CPC ..... *E21B 49/10* (2013.01); *E21B 2049/085* (2013.01)

(58) Field of Classification Search

None

See application file for complete search history.

(56) References Cited

U.S. PATENT DOCUMENTS

| | | | |
|---|---|---|---|
| 5,622,223 | A | 4/1997 | Vasquez |
| 6,490,916 | B1 | 12/2002 | Goodwin et al. |
| 6,758,090 | B2 | 7/2004 | Bostrom et al. |
| 7,114,562 | B2 | 10/2006 | Fisseler et al. |

(Continued)

FOREIGN PATENT DOCUMENTS

| | | |
|---|---|---|
| WO | 2009/082674 | 7/2009 |

OTHER PUBLICATIONS

Kamran Akbarzadeh, et al., "Asphaltenes—Problematic but Rich in Potential," Oilfield Review, Summer 2007, pp. 22-43.

(Continued)

*Primary Examiner* — Tsung-Yin Tsai

(74) *Attorney, Agent, or Firm* — Michael Dae

(57) ABSTRACT

Example systems described herein to perform downhole fluid analysis include a depressurizer to be positioned downhole in a geological formation to depressurize a formation fluid in the geological formation. In such example systems, the depressurization of the formation fluid is to cause bubbles to nucleate in the formation fluid. Such example systems also include an imaging processor to be positioned downhole in the geological formation. In such example systems, the imaging processor is to capture imaging data associated with the formation fluid and to detect nucleation of the bubbles in the formation fluid based on the imaging data. Such example systems further include a controller to report measurement data via a telemetry communication link to a receiver to be located outside the geological formation. In such example systems, the measurement data includes a bubble point of the formation fluid calculated based on the detected nucleation of the bubbles.

15 Claims, 11 Drawing Sheets

(56) References Cited

U.S. PATENT DOCUMENTS

| | | | | |
|---|---|---|---|---|
| 7,511,813 | B2 * | 3/2009 | Vannuffelen | G01J 3/18 250/269.1 |
| 8,023,690 | B2 * | 9/2011 | DiFoggio | G01J 3/02 382/100 |
| 8,262,909 | B2 | 9/2012 | Angelescu et al. | |
| 8,483,445 | B2 | 7/2013 | Tjhang et al. | |
| 8,528,396 | B2 * | 9/2013 | Wu | E21B 49/082 73/152.55 |
| 2002/0194907 | A1 | 12/2002 | Bostrom et al. | |
| 2005/0134845 | A1 | 6/2005 | Bordelon | |
| 2005/0165554 | A1 * | 7/2005 | Betancourt | E21B 49/08 702/11 |
| 2005/0192855 | A1 * | 9/2005 | Chitty | E21B 43/00 705/1.1 |
| 2006/0243047 | A1 * | 11/2006 | Terabayashi | E21B 49/10 73/152.55 |
| 2007/0035736 | A1 * | 2/2007 | Vannuffelen | E21B 49/08 356/432 |
| 2008/0154563 | A1 * | 6/2008 | Kumar | E21B 43/00 703/10 |
| 2009/0321072 | A1 | 12/2009 | Kanayama et al. | |
| 2010/0192684 | A1 | 8/2010 | Wu et al. | |
| 2012/0076364 | A1 * | 3/2012 | Tjhang | E21B 47/102 382/109 |
| 2012/0211650 | A1 * | 8/2012 | Jones | E21B 49/10 250/269.1 |
| 2013/0243028 | A1 * | 9/2013 | Singh | G01N 33/2823 374/43 |
| 2014/0103203 | A1 * | 4/2014 | Tjhang | G01V 8/10 250/269.1 |
| 2014/0253116 | A1 * | 9/2014 | Freedman | G01R 33/30 324/303 |
| 2014/0278113 | A1 * | 9/2014 | Chok | E21B 49/088 702/13 |

OTHER PUBLICATIONS

Farshid Mostowfi, et al., "Determining phase diagrams of gas-liquid systems using a microfluidic PVT," The Royal Society of Chemistry, Lab Chip, 2012, vol. 12, pp. 4381-4387.

A. Smits, et al, "In-Situ Optical Fluid Analysis as an Aid to Wireline Formation Sampling," SPE Formation Evaluation, Jun. 1995, pp. 91-98.

Y. Watanabe, "Real-time Visual Measurements Using High-speed Vision," Proc of SPIE, vol. 5603, Belingham, WA 2004, pp. 234-242.

I. Ishii et al, "Self Windowing for High Speed Vision", Proceedings of IEEE International Conference on Robotics and Automation, pp. 1916-1921, May 1999.

Idaku Ishii, Takashi Komura, and Masatoshi Ishikawa, "Method of moment calculation for a digital vision chip system," Fifth IEEE International Workshop on Computer Architectures for Machine Perception (2000)/ Proceedings. pp. 41-48.

International search report and written opinion for the equivalent PCT patent application No. PCT/US2014/063035 issued on Feb. 10, 2015.

* cited by examiner

METHODS AND SYSTEMS FOR DOWNHOLE FLUID ANALYSIS

BACKGROUND

Downhole fluid analysis is a useful and efficient investigative technique for ascertaining characteristics of geological formations having hydrocarbon deposits. For example, downhole fluid analysis can be used during oilfield exploration and development to determine petrophysical, mineralogical, and fluid properties of hydrocarbon reservoirs. Such fluid characterization can be integral to accurately evaluating the economic viability of a particular hydrocarbon reservoir formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Example systems to perform downhole fluid analysis disclosed herein include a depressurizer to be positioned downhole in a geological formation to depressurize a formation fluid in the geological formation. In such example systems, the depressurization of the formation fluid is to cause bubbles to nucleate in the formation fluid. Such example system further include an imaging processor to be positioned downhole in the geological formation. In such example systems, the imaging processor is to capture imaging data associated with the formation fluid and to detect the bubbles in the formation fluid based on the imaging data. Such example systems also include a controller to report measurement data via a telemetry communication link to a receiver to be located outside the geological formation. In such example systems, the measurement data includes, for example, a bubble point of the formation fluid calculated based on the detected nucleation of the bubbles.

Example methods for performing downhole fluid analysis disclosed herein include capturing, via an imaging processor positioned downhole in a geological formation, imaging data associated with a formation fluid in the geological formation. In such example methods, the formation fluid includes, for example, gas and oil. Such example methods include processing the imaging data to detect bubbles of the gas in the formation fluid. Such example methods also include calculating a gas-to-oil ratio of the formation fluid based on a ratio of a volume of the bubbles to a volume of the oil in the formation fluid. In such example methods, the volume of the bubbles is based on a summation of areas of the bubbles detected in the imaging data. Such example methods further include sending measurement data via a telemetry communication link to a receiver located outside the geological formation, the measurement data including the gas-to-oil ratio.

Other example systems to perform fluid analysis disclosed herein include a high-speed imaging processor to capture imaging data associated with a sample of formation fluid from a geological formation and to process the imaging data to detect bubbles in the sample of the formation fluid. Such example systems also include a controller to generate measurement data associated with the formation fluid in substantially real-time. In such example systems, the measurement data include a gas-to-oil ratio of the formation fluid based on a ratio of a volume of the bubbles to a total volume of the sample minus the volume of the detected bubbles. In such example systems, the volume of the bubbles is based on a summation of areas in the imaging data associated with the bubbles.

BRIEF DESCRIPTION OF THE DRAWINGS

Example methods and systems for downhole fluid analysis are described with reference to the following figures. Where possible, the same numbers are used throughout the figures to reference like features and components.

DETAILED DESCRIPTION

Figure 1:
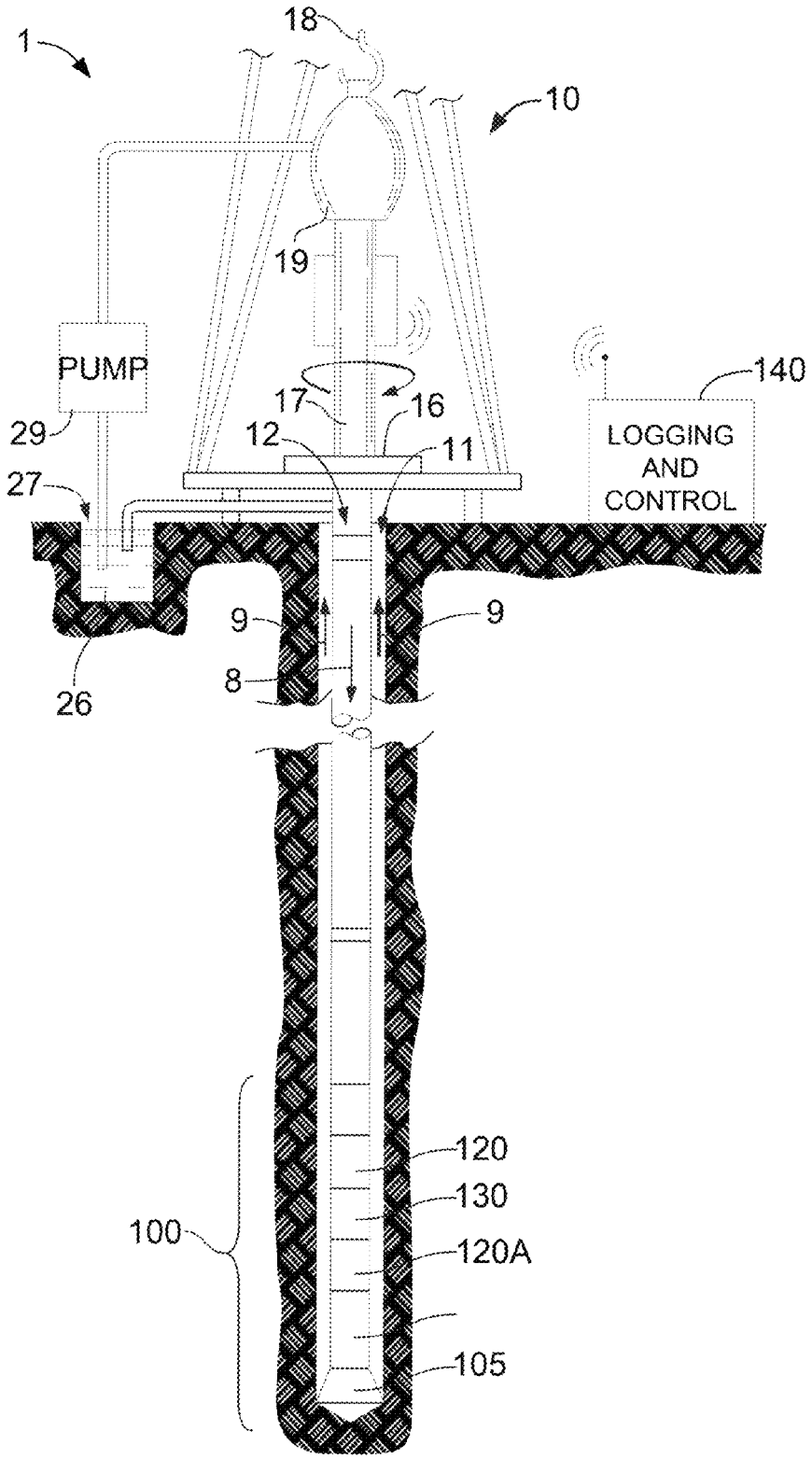
FIG. 1 illustrates an example system in which embodiments of methods and systems for downhole fluid analysis can be implemented.

In the following detailed description, reference is made to the accompanying drawings, which form a part hereof, and within which are shown by way of illustration specific examples of the teachings disclosed herein. It is to be understood that other examples may be utilized and structural changes may be made without departing from the scope of the disclosure.

Example methods and systems for downhole fluid analysis are disclosed herein. A complex mixture of fluids, such as oil, gas, and/or water, may be found downhole in reservoir formations. The downhole fluids, which are also referred to herein as formation fluids, have characteristics including pressure, temperature, volume, and/or other fluid properties that determine phase behavior of the various constituent elements of the fluids. To evaluate underground formations surrounding a borehole, in some instances, samples of formation fluids in the borehole are obtained and analyzed for purposes of characterizing the fluids, such as by determining composition analysis, fluid properties and phase behavior.

Formation fluids under downhole conditions of composition, pressure and temperature may be different from the fluids at surface conditions. For example, downhole temperatures in a well could be approximately 300 degrees Fahrenheit. When samples of downhole fluids are transported to the surface, the fluids tend to change temperature, and exhibit attendant changes in volume and pressure. The changes in the fluids as a result of transportation to the surface can cause phase separation between gaseous and liquid phases in the samples, and/or changes in compositional characteristics of the formation fluids.

Example systems, methods, and articles of manufacture disclosed herein employ high-speed imaging techniques, such as those described in U.S. Pat. No. 8,483,445, which is hereby incorporated by reference in its entirety, to enable in situ (e.g., downhole) PVT (e.g., pressure-temperature-volume) analysis of formation fluids. In particular, example downhole fluid analyzers are disclosed herein that can determine fluid analysis measurement data including the bubble point and/or the dew point (e.g., the saturation pressure at a given temperature) of a formation fluid in real-time or substantially real-time. The bubble point of a formation fluid corresponds to the dew point of the formation fluid. Accordingly, any reference to the bubble point of the formation fluid within this disclosure includes a reference to the dew point of the formation fluid as well, and vice versa. Additionally, example downhole fluid analyzers disclosed herein can determine the asphaltene onset pressure of a formation fluid in real-time or substantially real-time. Further, example systems, methods, and articles of manufacture disclosed herein enable a downhole fluid analyzer to determine the gas-to-oil ratio (GOR) of a formation fluid in real-time or substantially real-time. Such information may provide early indication of the condition and/or properties of the formation fluid to an operator. Based on such reported information, one or more suitable steps can be taken to avoid potential dangers to personnel or damage to the well resulting from, for example, a blow out from pressures that approach the bubble point and/or undesirable build up of asphaltenes.

Turning to the figures, FIG. 1 illustrates a wellsite system 1 in which examples disclosed herein can be employed. The wellsite can be onshore or offshore. In this example system, a borehole 11 is formed in subsurface formations by rotary drilling in a manner that is well known. Other examples can also use directional drilling.

A drill string 12 is suspended within the borehole 11 and has a bottom hole assembly 100 which includes a drill bit 105 at its lower end. The surface system includes platform and derrick assembly 10 positioned over the borehole 11, the derrick assembly 10 including a rotary table 16, a kelly 17, a hook 18 and a rotary swivel 19. The drill string 12 is rotated by the rotary table 16, energized by means not shown, which engages the kelly 17 at an upper end of the drill string 12. The drill string 12 is suspended from the hook 18, attached to a traveling block (also not shown), through the kelly 17 and the rotary swivel 19, which permits rotation of the drill string 12 relative to the hook 18. In some examples, a top drive system could be used.

In the illustrated example, the surface system further includes drilling fluid or mud 26 stored in a pit 27 formed at the well site. A pump 29 delivers the drilling fluid 26 to the interior of the drill string 12 via a port in the swivel 19, causing the drilling fluid 26 to flow downwardly through the drill string 12 as indicated by directional arrow 8. The drilling fluid 26 exits the drill string 12 via ports in the drill bit 105, and then circulates upwardly through the annulus region between the outside of the drill string 12 and the wall of the borehole 11, as indicated by directional arrows 9. In this manner, the drilling fluid 26 lubricates the drill bit 105 and carries formation cuttings up to the surface as it is returned to the pit 27 for recirculation.

The bottom hole assembly 100 of the illustrated example includes a logging-while-drilling (LWD) module 120, a measuring-while-drilling (MWD) module 130, a roto-steerable system and motor, and the drill bit 105.

The LWD module 120 is housed in a special type of drill collar, as is known in the art, and can contain one or more logging tools. It will also be understood that more than one LWD and/or MWD module can be employed, for example, as represented at 120A. References throughout to a module at the position of module 120 can mean a module at the position of module 120A. The LWD module 120 includes capabilities for measuring, processing, and storing information, as well as for communicating with the surface equipment. In the illustrated example, the LWD module 120 includes a fluid sampling device.

The wellsite system 1 also includes a logging and control unit 140 communicably coupled in any appropriate manner to the LWD module 120/120A and the MWD module 130. In the illustrated example, the LWD module 120/120A and/or the MWD module 130 include(s) an example downhole fluid analyzer as described in greater detail below to perform downhole fluid analysis in accordance with the example methods, apparatus and articles of manufacture disclosed herein. The downhole fluid analyzer included in the LWD module 120/120A and/or the MWD module 130 reports the measurement results for the downhole fluid analysis to the logging and control unit 140. Example downhole fluid analyzers that may be included in and/or implemented by the LWD module 120/120A and/or the MWD module 130 are described in greater detail below.

The MWD module 130 is also housed in a special type of drill collar, as is known in the art, and can contain one or more devices for measuring characteristics of the drill string 12 and the drill bit 105. The MWD module 130 further includes an apparatus (not shown) for generating electrical power to the downhole system. This may include a mud turbine generator powered by the flow of the drilling fluid 26, and/or other power and/or battery systems. In the illustrated example, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

Figure 2:
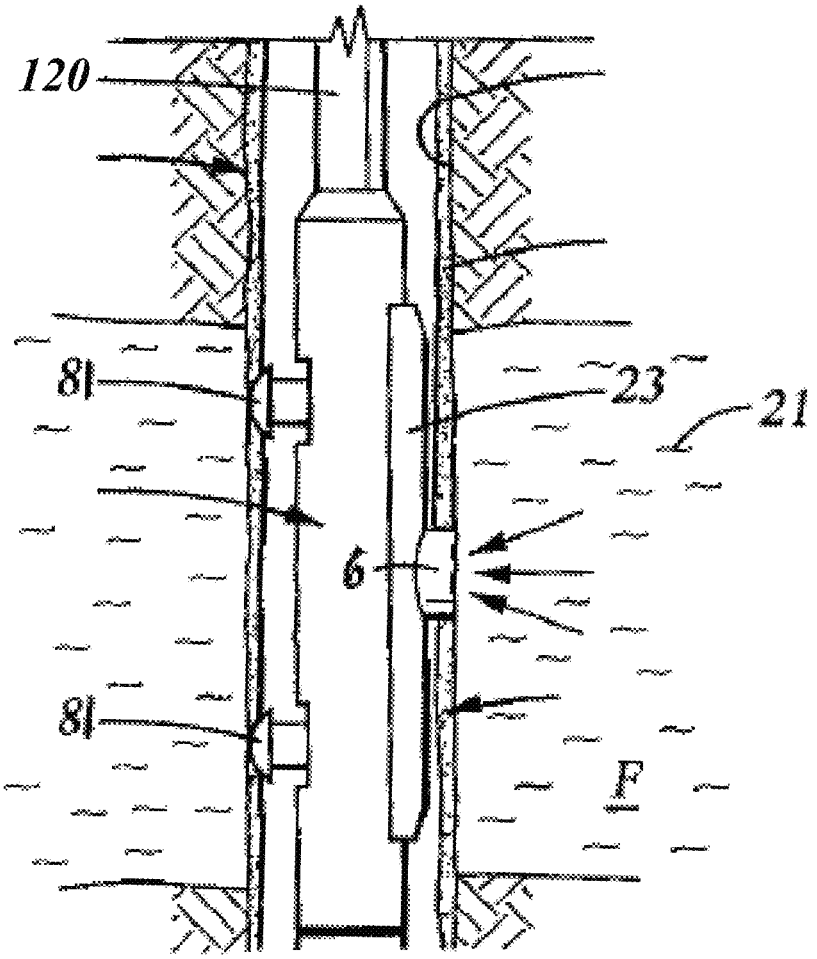
FIG. 2 illustrates another example system in which embodiments of methods and systems for downhole fluid analysis can be implemented.

FIG. 2 is a simplified diagram of a sampling-while-drilling logging device of a type described in U.S. Pat. No. 7,114,562, incorporated herein by reference, utilized as the LWD module 120 or part of the LWD module suite 120A. The LWD module 120 is provided with a probe 6 for establishing fluid communication with the formation and drawing fluid 21 into the module 120, as indicated by the arrows. The probe 6 may be positioned in a stabilizer blade 23 of the LWD module 120 and extended therefrom to engage a borehole wall. The stabilizer blade 23 comprises one or more blades that are in contact with the borehole wall. The fluid 21 drawn into the module 120 using the probe 6 may be measured to determine, for example, pretest and/or pressure parameters and/or properties and/or characteristics of the fluid 21 such as, for example, optical densities. The LWD module 120 may be provided with devices, such as sample chambers, for collecting fluid samples for retrieval at the surface. Backup pistons 81 may also be provided to assist in applying force to push the drilling tool and/or probe 6 against the borehole wall.

Figure 3:
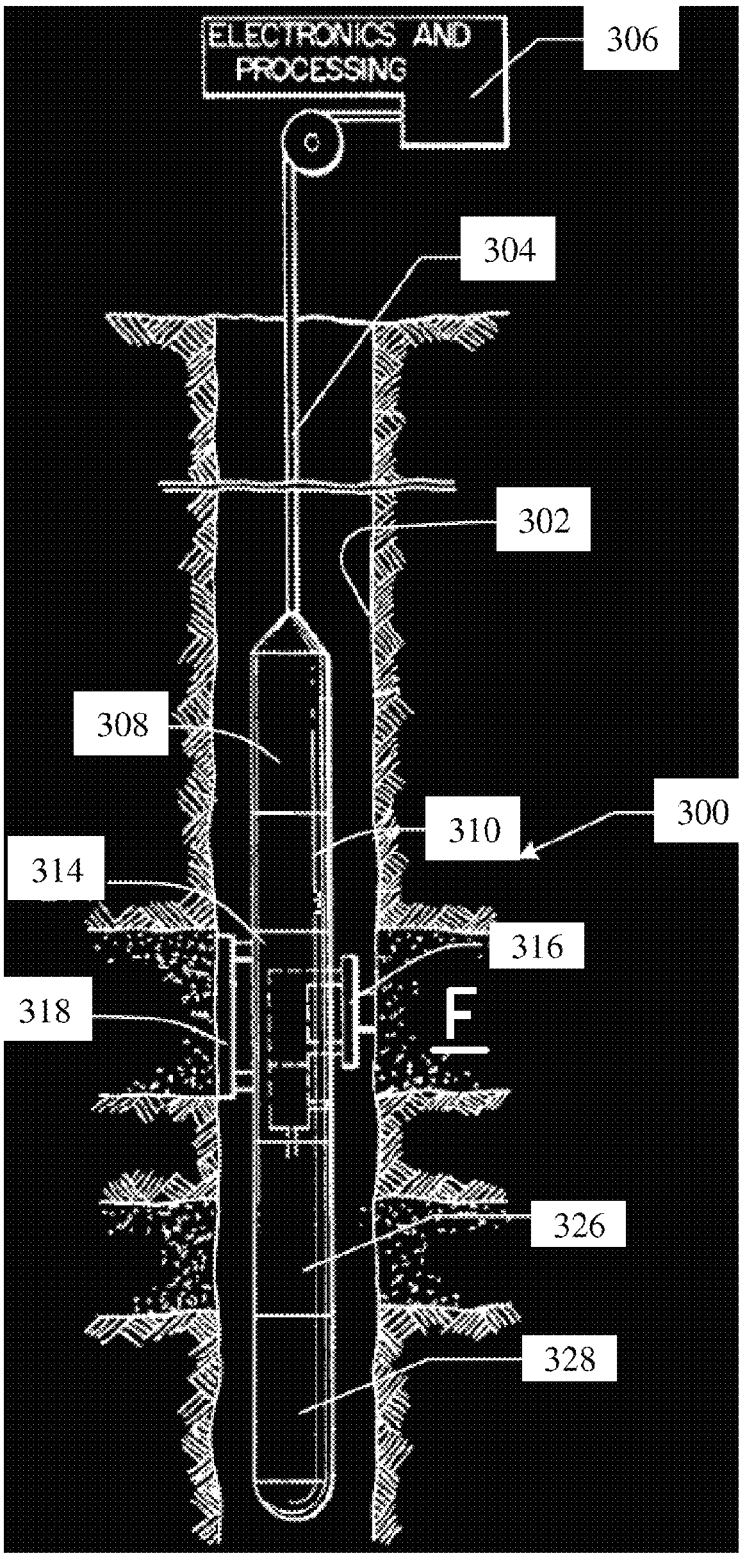
FIG. 3 illustrates another example system in which embodiments of methods and systems for downhole fluid analysis can be implemented.

FIG. 3 illustrates an example wireline tool 300 that may be another environment in which aspects of the present disclosure may be implemented. The example wireline tool 300 is suspended in a wellbore 302 from a lower end of a multiconductor cable 304 that is spooled on a winch (not shown) at the Earth's surface. At the surface, the cable 304 is communicatively coupled to an electronics and processing system 306. The example wireline tool 300 includes an elongated body 308 that includes a formation tester 314 having a selectively extendable probe assembly 316 and a selectively extendable tool anchoring member 318 that are arranged on opposite sides of the elongated body 308. Additional components (e.g., 310) may also be included in the tool 300.

One or more aspects of the probe assembly 316 may be substantially similar to those described above in reference to the probe 6 of FIG. 2. For example, the extendable probe assembly 316 is configured to selectively seal off or isolate selected portions of the wall of the wellbore 302 to fluidly couple to an adjacent formation F and/or to draw fluid samples from the formation F. Accordingly, the extendable probe assembly 316 may be provided with a probe having an embedded plate. The formation fluid may be expelled through a port (not shown) or it may be sent to one or more fluid collecting chambers 326 and 328. In the illustrated example, the electronics and processing system 306 and/or a downhole control system are configured to control the extendable probe assembly 316 and/or the drawing of a fluid sample from the formation F.

Figure 4:
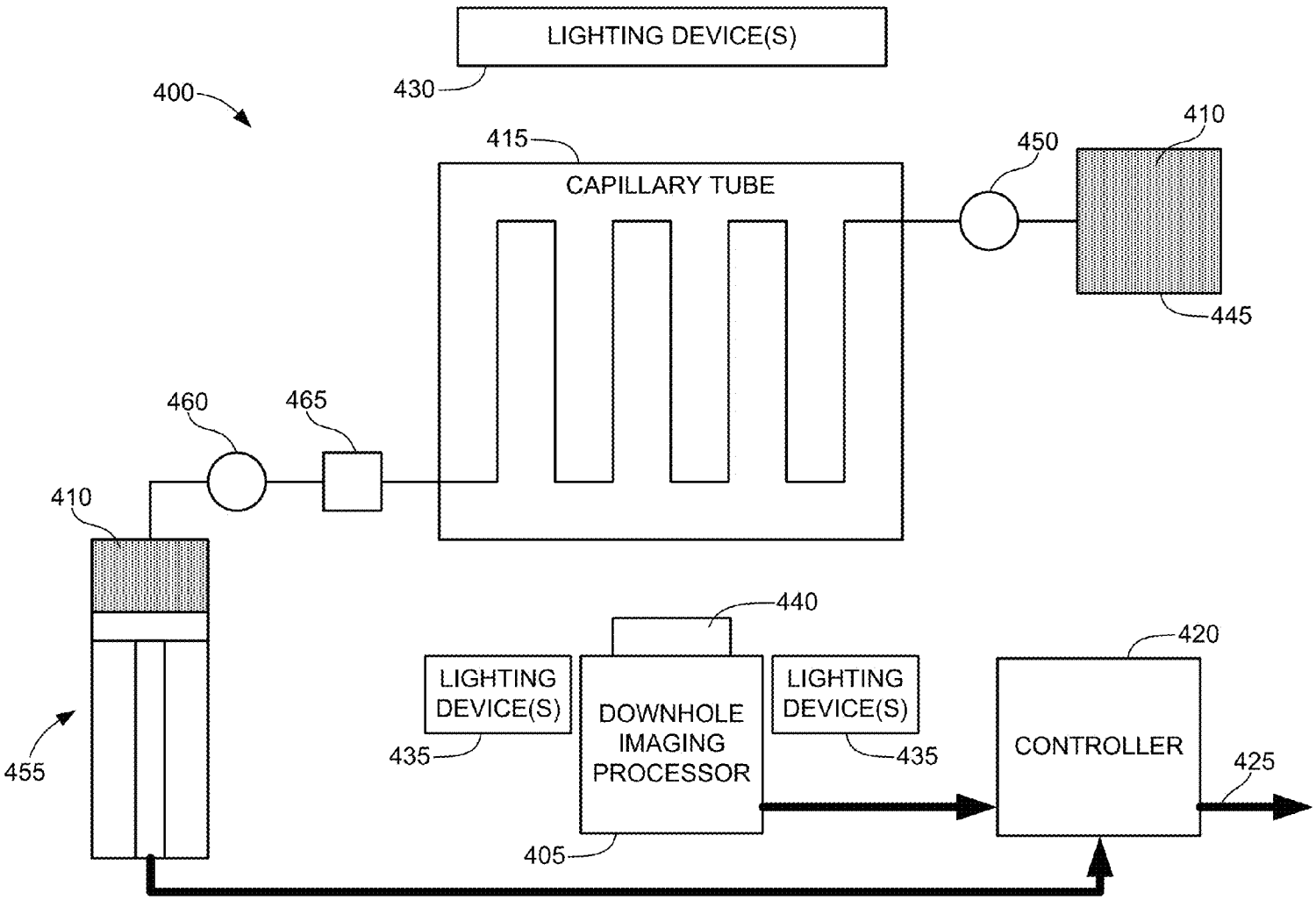
FIG. 4 illustrates a first example downhole fluid analyzer constructed in accordance with the teachings disclosed herein that may be used to perform downhole fluid analysis in the example systems of FIGS. 1, 2, and/or 3.

An example downhole fluid analyzer 400 that may be used to implement downhole fluid analysis in the wellsite system 1 of FIG. 1, the LWD modules 120 of FIGS. 1 and/or 2, and/or the wireline tool 300 of FIG. 3 in accordance with the teachings disclosed herein is illustrated in FIG. 4. The downhole fluid analyzer 400 of the illustrated example includes an example downhole imaging processor 405 that captures imaging data of a formation fluid 410 from a geological formation as the formation fluid 410 passes through an example capillary tube 415. The formation fluid 410 can include one or more gaseous, liquid and/or solid phases, such as, for example, water, oil, gas, flowable solid material, etc.

In some examples, the downhole imaging processor 405 is implemented in accordance with the downhole imaging process described in connection with U.S. Pat. No. 8,483,445. That is, the example downhole imaging processor 405 can be positioned downhole in a borehole or wellbore in the formation to perform light sensing and high-speed (e.g., real-time or substantially real-time) image processing of the sensed imaging data locally (e.g., downhole) where the formation fluid being analyzed is located.

For example, as described more fully in U.S. Pat. No. 8,483,445, the downhole imaging processor 405 includes an array of photo detectors to determine imaging data by sensing light that has contacted the formation fluid 410. The downhole imaging processor 405 further includes an array of processing elements associated with the array of photo detectors to process the imaging data to determine, for example, object boundary information for one or more objects (e.g., such as a bubble, a solid particulate (e.g., precipitated asphaltene), etc.) in the formation fluid 410. In the illustrated example, the processed imaging data determined by the downhole imaging processor 405 is further processed and formatted by an example controller 420 to determine downhole fluid analysis measurement data to be reported via an example telemetry communication link 425 to a receiver, such as the logging and control unit 140, located on the surface or otherwise outside the geological formation. For example, the controller 420 can process object boundary imaging data determined by the downhole imaging processor 405 to detect bubbles and/or asphaltenes in the formation fluid 410 and to determine the number, size(s), shape(s), and/or area(s) of such bubbles and/or precipitated asphaltenes, etc. In some examples, the controller 420 uses this data in connection with pressure and temperature data to determine the bubble point of the formation fluid 410 and/or the asphaltene onset pressure of the formation fluid 410 (e.g., the particular pressure for a given temperature at which asphaltenes begin to precipitate or aggregate within the formation fluid 410). Further, the example controller 420 may process the imaging data to calculate a gas-to-oil ratio (GOR) of the formation fluid 410. Additionally, the controller 420 can, for example, compress, encrypt, modulate and/or filter the processed data obtained from the downhole imaging processor 405 to format the data for reporting via the telemetry communication link 425. Example implementations of the controller 420 are described in greater detail below.

Because the downhole fluid analyzer 400 performs the bulk of its processing downhole and reports just a relatively small amount of measurement data up to the surface, the downhole fluid analyzer 400 can provide high-speed (e.g., real-time or substantially real-time) fluid analysis measurements using a relatively low bandwidth telemetry communication link 425. As such, the telemetry communication link 425 can be implemented by almost any type of communication link, even existing telemetry links used today.

In the illustrated example of FIG. 4, the downhole fluid analyzer 400 includes one or more example lighting devices 430, 435 to cause light to shine on and/or pass through the formation fluid 410 contained within the capillary tube 415. In some examples, the downhole imaging processor 405 is located on one side of the capillary tube 415 and the lighting device(s) 430 are located on the opposite side of the capillary tube 415 to provide back illumination to the formation fluid 410. In some examples, the lighting device(s) 435 are located on the same side of the capillary tube 415 as the downhole imaging processor 405 to provide front illumination to the formation fluid 410. The capillary tube 415 may be positioned within the field of view of the downhole imaging processor 405 in any suitable configuration. For example, the capillary tube 415 may pass through the field of view of the downhole imaging processor 405 in a single straight line, weave back and forth (e.g., as illustrated in FIG. 4), etc. Additionally, in some examples, more than one capillary tube 415 may be used. Thus, the arrangement of the capillary tube 415 is not limited to the illustrated examples shown. In some examples, the capillary tube 415 is positioned such that the entire length of the capillary tube 415 is in direct line-of-sight with the downhole imaging processor 405 and the lighting devices 430, 435. In this manner, the entire length of capillary tube 415 may be properly illuminated for visual sensing and subsequent analysis. In some examples, the capillary tube 415 is positioned at the depth of focus of an example lens system 440 of the downhole imaging processor 405 for accurate sensing of the formation fluid 410 within the capillary tube 415.

In the illustrated example of FIG. 4, the formation fluid 410 is fed into the capillary tube 415 via an example formation fluid source 445. For example, the formation fluid source 445 may be, but is not limited to, a sampling tool flow line (e.g., a tool with a sampling probe), a sample chamber, or a microfluidics system within the LWD module 120 of FIG. 1. In some such examples, the capillary tube 415 is filled with the formation fluid by opening a first example valve 450. In some examples, a discrete and predefined amount of formation fluid 410 is analyzed by the downhole fluid analyzer 400 corresponding to the volume of the capillary tube 415. That is, in some examples, once the capillary tube 415 is completely filled, the first valve 450 is closed and then the formation fluid 410 is illuminated and imaging data is captured, processed, and analyzed. In some examples, the formation fluid 410 is analyzed as it is continuously circulated through the capillary tube 415 at a controlled flow rate.

The analysis of the formation fluid 410 in accordance with the teachings disclosed herein involves the nucleation of bubbles in the formation fluid 410. Accordingly, as shown in the illustrated example, the downhole fluid analyzer 400 may include an example depressurizer 455 (e.g., a depressurizing pump or motor) in fluid communication with the capillary tube 415 via a second example valve 460. In such examples, during a fluid analysis procedure the depressurizer 455 depressurizes the formation fluid 410 to cause bubble nucleation within the formation fluid 410 as gas is drawn out of the fluid as the pressure drops below the bubble point of the formation fluid 410. In some examples, the depressurizer 455 provides pressure and temperature data associated with the formation fluid 410 to the controller 420 for subsequent analysis and/or processing. In some examples, the pressure and temperature data are measured via one or more example pressure and temperature gauges 465. During this process, the downhole imaging processor 405 visually monitors the formation fluid 410 to detect the nucleation of bubbles. In some examples, the resulting imaging data of the detected bubbles are analyzed to determine the volume of the bubbles. Furthermore, the volume of the bubbles may, in turn, be used to calculate a gas-to-oil ratio (GOR) of the formation fluid 410 as described more fully below. Additionally, in some examples, because the downhole imaging processor 405 implements high speed imaging technology, as the pressure and temperature of the formation fluid 410 is monitored while being depressurized, the particular pressure and temperature at which bubble nucleation occurs can be determined. For example, the pressure and temperature of the formation fluid 410 may be tracked over time (e.g., timestamped) as the depressurization occurs. During the same period, the downhole imaging processor 405 timestamps the imaging data to then be compared against the pressure and temperature data to determine the particular bubble point of the formation fluid 410.

Additionally, in some examples, the downhole imaging processor 405 of the downhole fluid analyzer 400 detects solid particulates or precipitates (e.g., asphaltenes) within the formation fluid 410. Frequently, asphaltenes are dissolved in formation fluids at high pressures and/or temperatures but will begin to aggregate or precipitate as the pressure and/or temperature of the fluid drops. The point at which asphaltene begins to come out of the formation fluid 410 (e.g., aggregate) is known as the asphaltene onset pressure. Accordingly, in some examples, similar to the detection of bubble nucleation and determination of the corresponding bubble point, the downhole fluid analyzer 400 is used to monitor the pressure and/or temperature of the formation fluid 410 as the fluid is depressurized until asphaltenes begin to appear to determine the asphaltene onset pressure.

Figure 5:
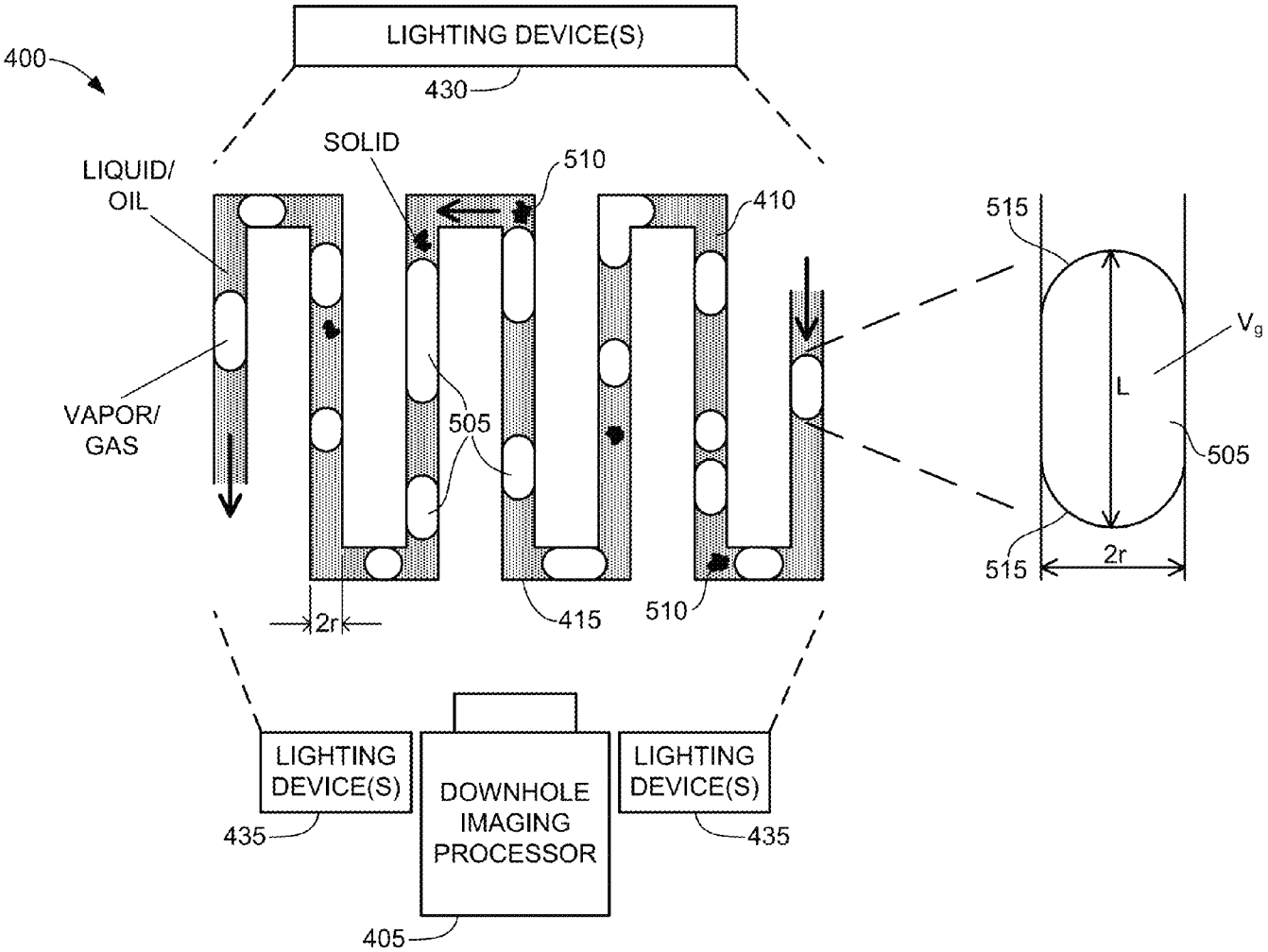
FIG. 5 shows additional detail of an example capillary tube in the first example downhole fluid analyzer of FIG. 4.

FIG. 5 is a detailed view of the capillary tube 415 of the example downhole fluid analyzer 400 of FIG. 4. Some of the elements shown in FIG. 4 have been removed to simplify the drawing but like elements are indicated with like reference numerals. Accordingly, the example illustration of FIG. 5 shows the same downhole imaging processor 405 and the same lighting devices 430, 435 as in FIG. 4. As shown in the illustrated example, the formation fluid 410 is shown in the capillary tube 415 with bubbles 505 and asphaltenes 510 already drawn out. That is, in the illustrated example of FIG. 5, the formation fluid 410 has already been depressurized (e.g., by the depressurizer 455) to a pressure below the asphaltene onset pressure and below the bubble point.

In some examples, the width or diameter (e.g., 2r) of the capillary tube 415 is designed to be less than the diameter of the bubbles 505. As a result, bubbles 505 extend across an entire cross-section of the capillary tube 415. In other words, the bubbles 505 are large enough, relative to the capillary tube 415, to contact the perimeter of a cross-section of the capillary tube 415. In this manner, the bubbles 505 are separated from the rest of the formation fluid 410 along a length of the capillary tube 415, thereby reducing overlap of the bubbles and the rest of the formation fluid in a line-of-sight of the downhole imaging processor 405. Put another way, a bubble 505 in the illustrated example may be identified by a length of the capillary tube 415 demarcated by two opposing menisci 515. As a result, in examples where the formation fluid is opaque (e.g., contains black heavy oil), light can still pass through the lengths of the capillary tube 415 containing the bubbles 505 and the downhole imaging processor 405 can detect the bubbles 505 for further analysis.

In some examples, as the formation fluid 410 is depressurized the bubbles 505 will travel along the capillary tube 415 at a relatively high rate of speed. However, because the example imaging processor 405 uses high-speed imaging techniques, the bubbles 505 can be accurately detected and analyzed. In some examples, bubble analysis includes measuring the volume of the bubbles 505. In some examples, the volume of a bubble 505 is determined based on the length (L) of the bubble, the width of the bubble (corresponding to the diameter (2r) of the capillary tube 415), and the shape of the menisci 515 associated with the bubble 505. Based on the calculated volume of the bubbles 505, the gas-to-oil ratio (GOR) can be determined using the following equation:

$$GOR = \frac{\sum_{i=0}^{n-1} V_i}{V_0 - \sum_{i=0}^{n-1} V_i} \qquad \text{Equation 1}$$

In equation 1, $V_i$ is the volume of the i-th bubble detected inside the capillary tube 415 and $V_0$ is the total volume of the initial sample formation fluid 410 (e.g., before depressurization). In some examples, the volume of a bubble ($V_i$) is calculated using the length (L), the diameter (2r), and the shape of the menisci 515 as described above. In some examples, the total volume of the initial sample ($V_0$) is known based on the dimensions of the capillary tube 415. For instance, as described above, in some examples, the volume of the capillary tube 415 is configured to hold a discrete and predefined amount of formation fluid 410 (e.g., based on the cross-sectional area of the capillary tube 415 multiplied by its total length). In some examples, the formation fluid 410 is not analyzed in discrete samples but continuously as the formation fluid 410 is circulated through the capillary tube 415. In some such examples, the total volume of the initial sample ($V_0$) can be calculated based on a known flow rate of the initial fluid sample.

In some examples, the volume of each bubble ($V_i$) and the total volume of the initial sample ($V_0$) are calculated based on the area of each bubble 505 and the area of entire capillary tube 415 being analyzed by the downhole imaging processor 405. That is, in some examples, because the bubbles 505 completely fill cross-sectional portions of the capillary tube 415, the third dimension in the volumetric ratio of equation 1 may be dropped out and the corresponding areas used instead.

In some examples, as the formation fluid 410 is depressurized in the capillary tube 415 asphaltenes will precipitate. In some examples, the downhole imaging processor 405 may use high-speed imaging techniques to detect the precipitated asphaltenes 510 and, more particularly, to detect the asphaltene onset pressure based on when the asphaltenes 510 begin to aggregate in the formation fluid 410 as described in Akbarzadeh et al., "Asphaltenes—Problematic but Rich in Potential", Oilfield Review, Vol. 19, No. 2, pp. 22-43, Jul. 1, 2007, which is incorporated herein by reference in its entirety. As shown in the illustrated example, the asphaltenes 510 may be smaller than the diameter of the capillary tube 415 such that the asphaltenes 510 are surrounded by the formation fluid 410. In some examples, the formation fluid 410 may be non-opaque (e.g., a light oil, a high water concentration mixture, etc.) such that the downhole imaging processor 405 may detect the asphaltenes 510 through the formation fluid 410. In some examples, the downhole imaging processor 405 may detect the asphaltenes 510 even when the formation fluid is opaque because the diameter of the capillary tube 415 is sufficiently small to allow light emitted from the lighting devices 430, 435 to be transmitted through the formation fluid 410. The particular diameter of the capillary tube 415 to enable detection of asphaltenes 510 within an opaque fluid may depend upon the intensity and wavelength of the light and the transmittance of the formation fluid 410 as defined by the Beer-Lambert Law. In a similar manner, in some examples, bubbles 505 that are smaller than the diameter of the capillary tube 415 may also be detected within the formation fluid 410. In some examples, the volume of the asphaltenes 510 within the formation fluid 410 may be calculated or estimated to be accounted for in calculating the GOR of the formation fluid 410.

Using the high-speed imaging techniques described above, which is based on an array of photo detectors associated with an array of processing elements, the example downhole imaging processor 405 may distinguish between the bubbles 505 and the asphaltenes 510. For example, the downhole imaging processor 405 can detect the amount (e.g., intensity) of light passing through the formation fluid 410, the bubbles 505, and the asphaltenes 510 from the back illumination provided by the lighting device(s) 430. As represented in FIG. 5, asphaltenes 510 absorb the most amount of light (e.g., appear the darkest) and the bubbles 505 absorb the least amount of light (e.g., appear the lightest) with the formation fluid 410 having light absorptivity in between the asphaltenes 510 and the bubbles 505. Based on this difference, the example downhole imaging processor 405 can differentiate between each of the formation fluid 410, the bubbles 505, and the asphaltenes 510. In some examples, the downhole imaging processor 405 also differentiates between the bubbles 505 and the asphaltenes 510 based on shape because the bubbles may be defined by generally spherically curved boundaries whereas the asphaltenes 510 may be irregularly shaped. Based on these distinguishing characteristics, in some examples, the downhole fluid analyzer 400 tracks the movement of the bubbles 505 and the asphaltenes 510 over time to determine multiphase flow rate measurements indicative of the flow rate of the bubbles 505 and the flow rate of the asphaltenes 510 for comparison relative to the flow rate of the formation fluid 410.

Figure 6:
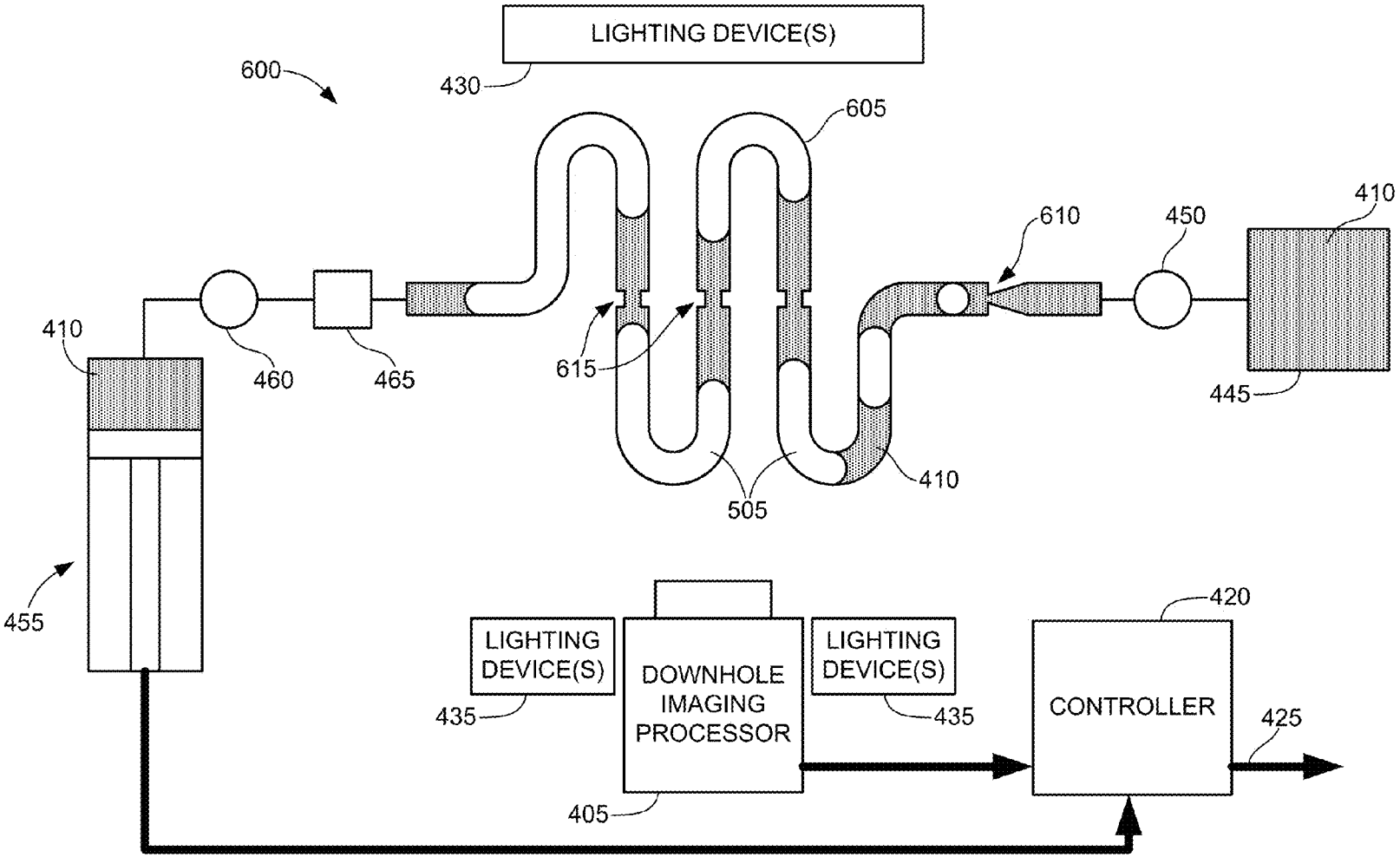
FIG. 6 illustrates a second example downhole fluid analyzer constructed in accordance with the teachings disclosed herein that may be used to perform downhole fluid analysis in the example systems of FIGS. 1, 2, and/or 3.

A second example downhole fluid analyzer 600 that may be used to perform downhole fluid analysis in the wellsite system 1 of FIG. 1, the LWD modules 120 of FIGS. 1 and/or 2, and/or the wireline tool 300 of FIG. 3 in accordance with the teachings disclosed herein is illustrated in FIG. 6. The second example downhole fluid analyzer 600 includes many elements, such as the downhole imaging processor 405, the controller 420, the telemetry communication link 425, the lighting devices 430, 435, the formation fluid source 445, the depressurizer 455, the first and second valves 450, 460, and the pressure and temperature gauge(s) 465, in common with the first example downhole fluid analyzer 400 of FIGS. 4 and 5. As such, like elements in FIGS. 4-6 are labeled with the same reference numerals. The detailed descriptions of these like elements are provided above in connection with the discussion of FIGS. 4 and 5 and, in the interest of brevity, are not repeated in the discussion of FIG. 6.

The example downhole fluid analyzer 600 of FIG. 6 varies from the example downhole fluid analyzer 400 of FIGS. 4 and 5 in the configuration of the capillary tube. In particular, FIG. 6 illustrates another example capillary tube 605 in a different configuration than the capillary tube 415 of FIGS. 4 and 5. As described above, as the formation fluid 410 is depressurized gas within the formation fluid 410 will be drawn out to form bubbles (e.g., the bubbles 505). Theoretically, the bubbles 505 will nucleate and appear in the formation fluid in a very short period of time corresponding to when the pressure of the formation fluid 410 reaches the bubble point. However, in some examples, there may be some lag in the nucleation of the bubbles 505 because the free-energy barrier to bubble nucleation is not overcome until the pressure of the formation fluid 410 has lowered passed the bubble point, thereby resulting in a supersaturated state. To reduce the likelihood of a supersaturated state developing, in some examples, bubble nucleation is facilitated with geometric restrictions, such as an example inlet restriction 610 at the inlet into the capillary tube 605 and/or example channel restrictions 615 at locations along the capillary tube 605. Example geometrical restrictions are described in greater detail in Mostowfi et al., "Determining phase diagrams of gas-liquid systems using microfluidic PVT," Lab Chip, Vol. 12, Issue 21, pp. 5381-87 (Nov. 8, 2012), which is incorporated herein by reference in its entirety. The geometric restrictions 610 and/or 615 of the illustrated example facilitate the onset of bubble nucleation by reducing the free-energy barrier, thereby enabling more accurate detection of the bubble point. Additionally, in some examples, bubble nucleation is facilitated with an agitator (e.g., a propeller), not shown, to create turbulence within the formation fluid 410, thereby reducing the free-energy barrier to bubble nucleation. In some examples, one or more heat pulses are applied locally to portions of the capillary tube 605 to facilitate bubble nucleation.

Figure 7:
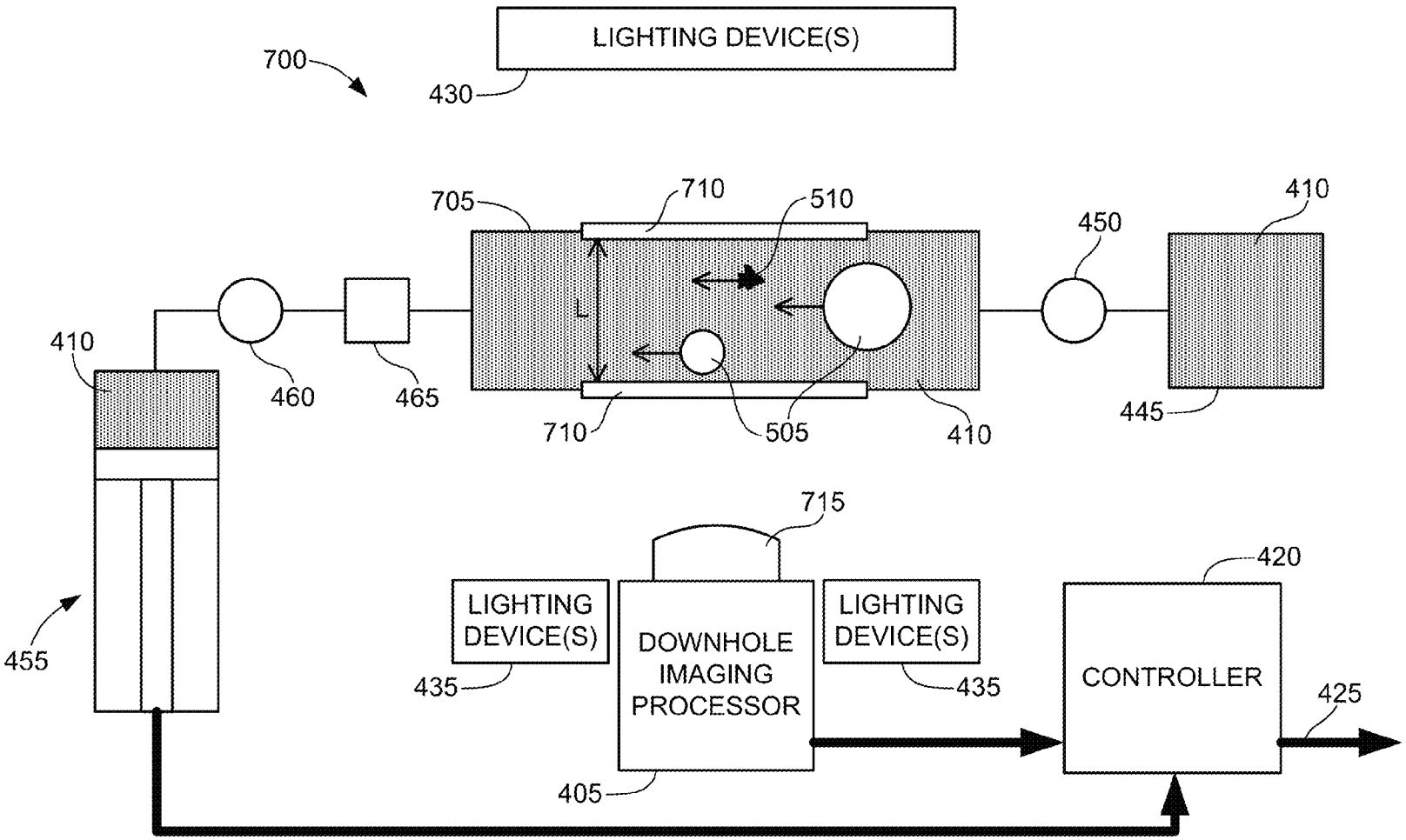
FIG. 7 illustrates a third example downhole fluid analyzer constructed in accordance with the teachings disclosed herein that may be used to perform downhole fluid analysis in the example systems of FIGS. 1, 2, and/or 3.

A third example downhole fluid analyzer 700 that may be used to perform downhole fluid analysis in the wellsite system 1 of FIG. 1, the LWD modules 120 of FIGS. 1 and/or 2, and/or the wireline tool 300 of FIG. 3 in accordance with the teachings disclosed herein is illustrated in FIG. 7. The third example downhole fluid analyzer 700 includes many elements, such as the downhole imaging processor 405, the controller 420, the telemetry communication link 425, the lighting devices 430, 435, the formation fluid source 445, the depressurizer 455, the first and second valves 450, 460, and the pressure and temperature gauge(s) 465, in common with the first example downhole fluid analyzer 400 of FIGS. 4 and 5. As such, like elements in FIGS. 4, 5, and 7 are labeled with the same reference numerals. The detailed descriptions of these like elements are provided above in connection with the discussion of FIGS. 4 and 5 and, in the interest of brevity, are not repeated in the discussion of FIG. 7.

In the illustrated example of FIG. 7, the downhole fluid analyzer 700 is configured to analyze the formation fluid 410 as it travels through an example flow line 705. As shown in the illustrated example, the diameter or depth (L) of the flow line 705 is greater than the diameter of one or more of the bubbles 505 within the formation fluid 410. As a result, the liquid of the formation fluid 410 surrounding a bubble 505 may conceal the bubble from view if the liquid is opaque (e.g., black oil). Accordingly, in some examples, the downhole fluid analyzer 700 is configured to analyze a formation fluid 410 that is non-opaque (e.g., light oil, water mixture, etc.). To do so, the example downhole fluid analyzer 700 includes the lighting device(s) 430 to provide back illumination and/or the lighting devices 435 to provide front illumination. Further, as shown in the illustrated examples, the flow line 705 includes substantially transparent windows 710 (e.g., sapphire windows that can withstand high pressures) to enable the light to contact the fluid and to be sensed by the downhole imaging processor 405.

In some examples, the gas-to-oil ratio (GOR) of the formation fluid is calculated using equation 1 described above. However, in the illustrated example of FIG. 7, because the bubbles are free floating within the flow line 705 rather than restrained by the narrow diameter of a capillary tube, the volume of each bubble ($V_g$) is calculated based on a measured diameter of the bubble. In some examples, the downhole fluid analyzer 700 includes an example lens system 715, as described more fully in U.S. Pat. No. 8,483,445, containing a focal-adjustable lens to identify bubbles floating in the formation fluid 410 at different depths within the flow line 705. Thus, while the example downhole fluid analyzer 400 of FIG. 4 may ignore the depth dimension of the bubbles 505 by calculating the GOR as described above in connection with equation 1 based on the two-dimensional areas of the bubbles 505 within the capillary tube 415, the example downhole fluid analyzer 700 of FIG. 7 uses the lens system 715 to capture the depth dimension for calculating the volume of each bubble ($V_i$) used in the summation of equation 1.

In addition to calculating the volume of the bubbles 505 to determine the GOR using equation 1, in some examples, the downhole fluid analyzer 700 may be used to determine the bubble point of the formation fluid 410 by detecting when the bubbles 505 first begin to appear (e.g., the gas comes out of the formation fluid 410). Furthermore, in some examples, the downhole fluid analyzer 700 of FIG. 7 may be used to detect asphaltenes 510 in the formation fluid 410 as described above for the example downhole fluid analyzer 400 of FIG. 4. Accordingly, in some examples, the downhole fluid analyzer 700 may also detect the asphaltene onset pressure of the formation fluid 410.

In some examples, the lighting device(s) 430, 435 of FIGS. 4-7 can correspond to fluorescent lighting sources. In some examples, the lighting device(s) 430, 435 can provide stripe or dot pattern illumination. In some examples, the downhole fluid analyzers 400, 600, 700 can support multiple lighting devices with different angles of lighting and/or combinations of the back illumination lighting device(s) 430 and the front illumination lighting device(s) 435. In some examples, the downhole fluid analyzers 400, 600, 700 include a light focusing device (e.g., adjustable lens, mirrors, etc.) positioned and controllable (e.g., by the controller 420) to adjust the light emanating from the lighting devices 430, 435.

Figure 8:
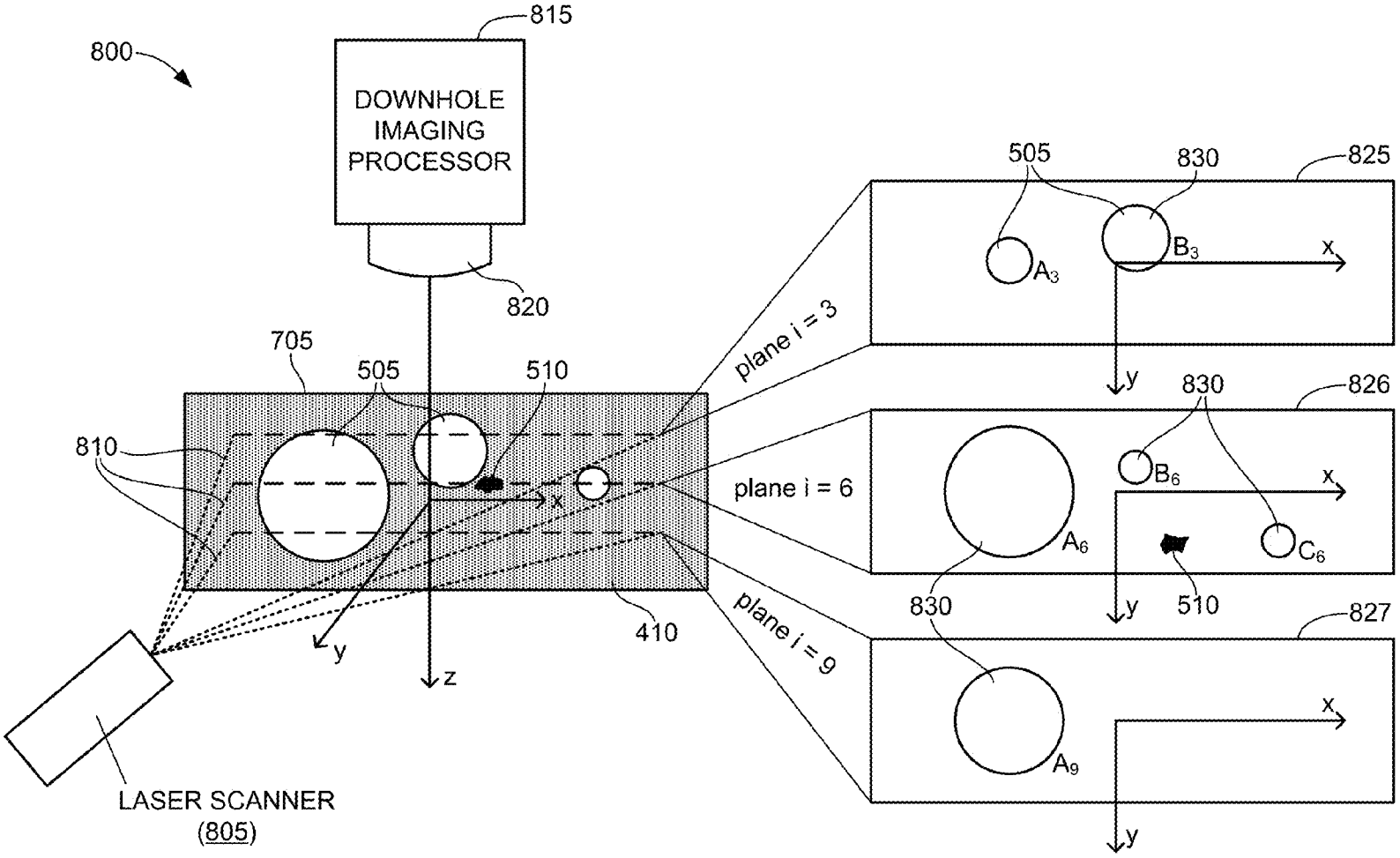
FIG. 8 illustrates a fourth example downhole fluid analyzer constructed in accordance with the teachings disclosed herein that may be used to perform downhole fluid analysis in the example systems of FIGS. 1, 2, and/or 3.

A fourth example downhole fluid analyzer 800 that may be used to implement downhole fluid analysis in the wellsite system 1 of FIG. 1, the LWD modules 120 of FIGS. 1 and/or 2, and/or the wireline tool 300 of FIG. 3 in accordance with the teachings disclosed herein is illustrated in FIG. 8. The fourth example downhole fluid analyzer 800 is similar to the third example downhole fluid analyzer 700 of FIG. 7, although some of the elements of FIG. 7 have been removed from FIG. 8 to simplify the drawing. Additionally, the fourth example downhole fluid analyzer 800 includes an example laser scanner 805 to generate laser sheets 810 across the formation fluid 410 at different depths within the flow line 705. As the flow line 705 has a diameter or depth larger than the bubbles 505, in some examples, the example downhole fluid analyzer 800 is configured to analyze non-opaque fluids. Further, as shown in the illustrated example, the downhole fluid analyzer 800 includes an example imaging processor 815 with an example lens system 820 having a focal adjustable lens similar to the lens system 715 of FIG. 7.

In some examples, the imaging processor 815 is configured to function similarly to the downhole imaging processor 405 of FIG. 7 except that the imaging processor 815 of FIG. 8 sense light from the laser sheets 810 contacting objects (e.g., the bubbles 505 and/or the asphaltenes 510) in the formation fluid 410 rather than sensing light from the lighting devices 430, 435. Further, in some such examples, the lens system 820 is configured to focus at the depth associated with each laser sheet 810 to accurately collect imaging data at the associated depth during each pass of the laser scanner 805. That is, in some examples, the image plane (e.g., the depth where the lens system 820 is focused) of the downhole imaging processor 405 changes to correspond to the depth of each laser sheet 820 as it is being generated by the laser scanner 805. By implementing the example downhole fluid analyzer 800 in this manner, the three-dimensional composition of the formation fluid 410 can be approximated by a series of two-dimensional image planes 825, 826, 827 stacked from the 0-th to the (p−1)st plane. For example, three separate two-dimensional image planes 825, 826, 827 are shown in the example illustration corresponding to plane 3, plane 6, and plane 9, respectively. Within each of the two-dimensional image planes 825, 826, 827 of the illustrated example, each of the bubbles 505 is represented by a cross-sectional area or segment 830 at the depth of the corresponding two-dimensional image plane 825, 826, 827.

The volume of each bubble 505 may be approximated as the summation of each cross-sectional segment 830 for the bubble 505 multiplied by a thickness (e.g., predefined or otherwise determined) of the two-dimensional image planes 825, 826, 827. Accordingly, the total volume of gas ($V_g$) (e.g., the combined volume of the bubbles 505 in the formation fluid 410) can be expressed as the summation of the cross-sectional areas or segments 830 for of the bubbles 505 detected in the formation fluid 410 multiplied by the plane thickness or depth (d) as follows:

$$V_g = d = \Sigma_{j=0}^{P-1}(A_j + B_j + C_j + \ldots) \quad \text{Equation 2}$$

Where $A_j$ is the area of the cross-sectional segment 830 corresponding to bubble A on the j-th plane, $B_j$ is the area of the cross-sectional segment 830 corresponding to bubble B on the j-th plane, and $C_j$ is the area of the cross-sectional segment 830 corresponding to bubble C on the j-th plane, and so forth. Equation 2 can then be used to derive the gas-to-oil ratio (GOR) for the formation fluid 410 as follows:

$$GOR = \frac{V_g}{V_0 - V_g} \quad \text{Equation 3}$$

In equation 3, $V_0$ is the total volume of the initial sample and is known based on the flow rate and/or discrete volume of the sample fluid used in the analysis as described above. In some examples, the thickness (d) of each image plane 825, 826, 827 may be dropped from equation 2 and incorporated into the total volume of the initial sample ($V_0$) to then calculate the GOR based directly on the summation of the areas of the cross-sectional segments 830. In some examples, by increasing the number of the two-dimensional image planes 825, 826, 827 (e.g., increasing the number of laser sheets scanned across the formation fluid) with a corresponding decrease in the thickness of each two-dimensional image plane 825, 826, 827 the accuracy of the volumetric calculation increases.

Although the example downhole fluid analyzers 700, 800 are described above as being configured for analyzing non-opaque fluids, in some examples, such as those described above in connection with the downhole fluid analyzer 400 of FIGS. 4 and 5, the diameter or depth of the flow line 705 may be sufficiently small to enable visible light to pass through the formation fluid 410, even when the formation fluid 410 is opaque. In this manner, the bubbles 505 and/or the asphaltenes 510 may be detected as described above for an opaque formation fluid 410.

In some examples, the lighting devices 430, 435 and/or the laser scanner 805 of the example downhole fluid analyzers 400, 600, 700, 800 may emit infrared light (e.g., near-infrared light) in addition to or instead of visible light and the corresponding downhole imaging processors 405, 815 may be sensitive to such infrared light (e.g., the downhole imaging processor 405, 815 may include an infrared complementary metal-oxide-semiconductor (CMOS) sensor). In this manner, the example imaging processor 405 may detect objects (e.g., bubbles 505 and/or asphaltenes 510) that are smaller than the diameter of the capillary tube 415, 605 and/or the flow line 705 even when the formation fluid 410 is opaque and the diameter or depth is too wide to allow the transmission of visible light because the infrared light will penetrate into the fluid.

In some examples, the downhole fluid analyzers 400, 600, 700, 800 implement one or more self-windowing algorithms, such as the examples described in Ishii et al, "Self Windowing for High Speed Vision", Proceedings of IEEE International Conference on Robotics and Automation, pp. 1916-1921, May 1999, which is incorporated herein by reference in its entirety. Furthermore, any of the example downhole fluid analyzers 400, 600, 700, 800 described above may include other sensors, devices, and/or mechanisms to facilitate their operation. For instance, in some examples, the downhole fluid analyzers 400, 600, 700, 800 described above can include one or more cooling devices to reduce and/or maintain analyzer operating temperature. For example, the downhole fluid analyzers 400, 600, 700, 800 can include thermo-electric cooler(s) (e.g., peltier device(s)) and/or other cooling mechanisms to reduce the operating temperature(s) of one or more semiconductor and/or other processing devices used to implement the downhole fluid analyzers 400, 600, 700, 800. Additionally, in some examples, the downhole fluid analyzers 400, 600, 700, 800 described above may include other sensors to monitor and/or determine other characteristics associated with the formation fluid 410 such as, for example, density, viscosity, resistivity, pH, etc.

While example manners of implementing the example downhole fluid analyzers 400, 600, 700, 800 are illustrated in FIGS. 4-8, one or more of the elements, processes and/or devices illustrated in FIGS. 4-8 may be combined, divided, re-arranged, omitted, eliminated and/or implemented in any other way. Further, the example downhole imaging processors 405 and/or 815, the example controller 420, the example telemetry communication link 425, the example lighting devices 430 and/or 435, the example lens systems 440, 715, and/or 820, the example depressurizer 455, the example laser scanner 805, and/or, more generally, the example downhole fluid analyzers 400, 600, 700, and/or 800 of FIGS. 4-8 may be implemented by hardware, software, firmware and/or any combination of hardware, software and/or firmware. Thus, for example, any of the example downhole imaging processors 405 and/or 815, the example controller 420, the example telemetry communication link 425, the example lighting devices 430 and/or 435, the example lens systems 440, 715, and/or 820, the example depressurizer 455, the example laser scanner 805, and/or, more generally, the example downhole fluid analyzers 400, 600, 700, and/or 800 of FIGS. 4-8 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, the example downhole imaging processors 405 and/or 815, the example controller 420, the example telemetry communication link 425, the example lighting devices 430 and/or 435, the example lens systems 440, 715, and/or 820, the example depressurizer 455, and/or the example laser scanner 805 is/are hereby expressly defined to include a tangible computer readable storage device or storage disk such as a memory, a digital versatile disk (DVD), a compact disk (CD), a Blu-ray disk, etc. storing the software and/or firmware. Further still, the example downhole fluid analyzers 400, 600, 700, 800 of FIGS. 4-8 may include one or more elements, processes and/or devices in addition to, or instead of, those illustrated in FIGS. 4-8, and/or may include more than one of any or all of the illustrated elements, processes and devices.

Figure 9:
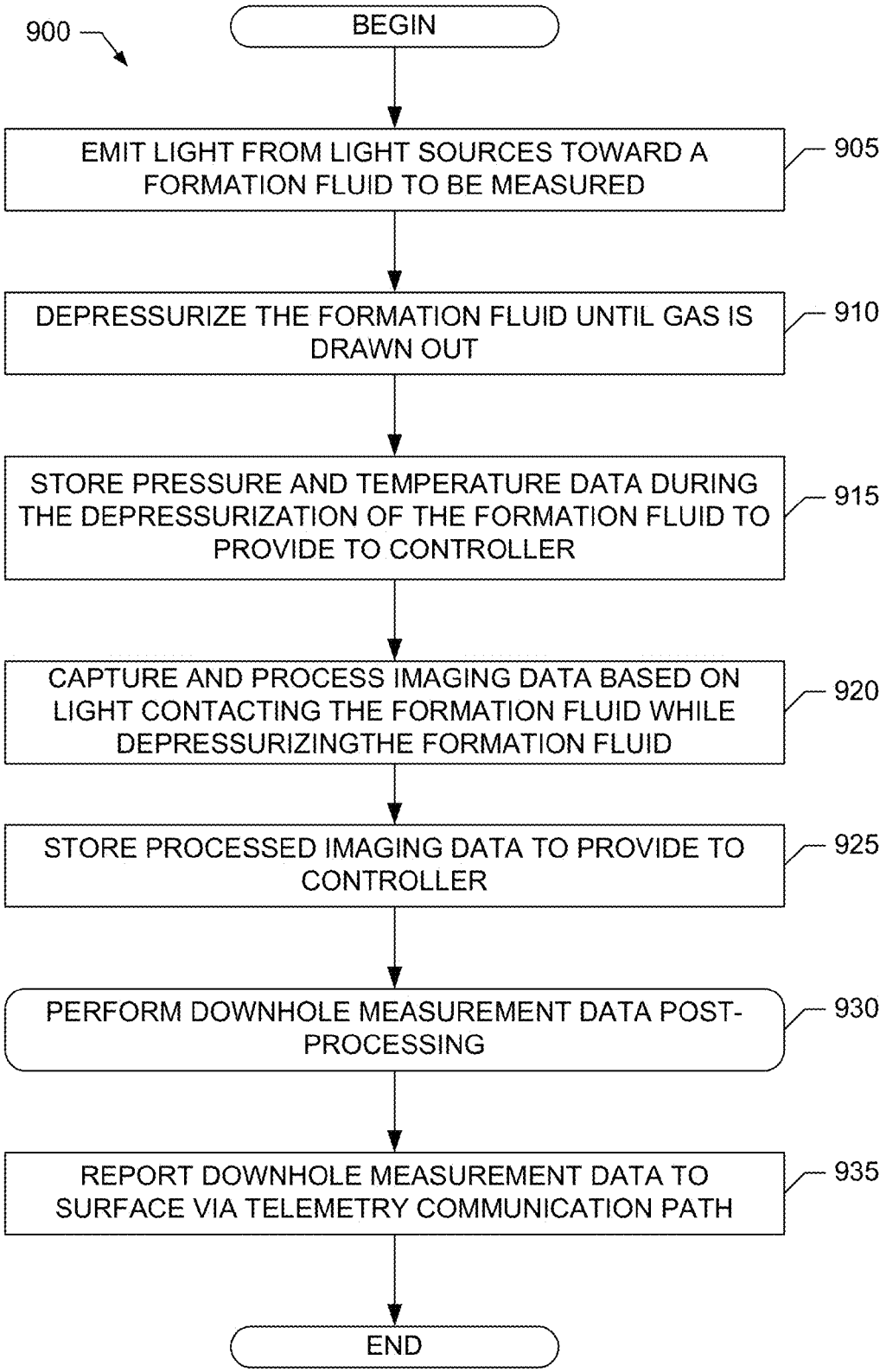
FIG. 9 is a flowchart representative of an example process that may be performed to implement the example downhole fluid analyzers of FIGS. 4, 5, 6, 7, and/or 8.
Figure 10:
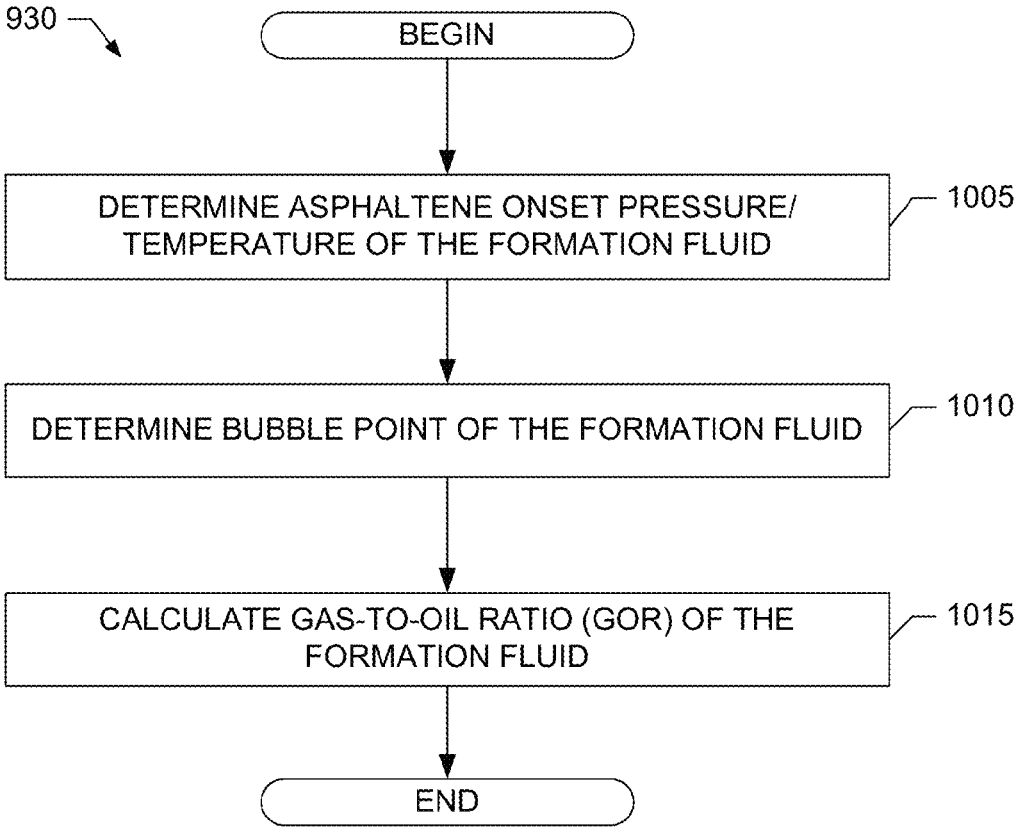
FIG. 10 is a flowchart representative of an example process that may be performed to implement post-processing in the example downhole fluid analyzers of FIGS. 4, 5, 6, 7, and/or 8.

Flowcharts representative of example machine readable instructions for implementing the example downhole fluid analyzers 400, 600, 700, 800 of FIGS. 4-8 are shown in FIGS. 9-10. In this example, the machine readable instructions comprise one or more programs for execution by a processor such as the processor 1112 shown in the example processor platform 1100 discussed below in connection with FIG. 11. The program(s) may be embodied in software stored on a tangible computer readable storage medium such as a CD-ROM, a floppy disk, a hard drive, a digital versatile disk (DVD), a Blu-ray disk, or a memory associated with the processor 1112, but the entire program(s) and/or parts thereof could be executed by a device other than the processor 1112 and/or embodied in firmware or dedicated hardware. Further, although the example program(s) are described with reference to the flowcharts illustrated in FIGS. 9-10, many other methods of implementing the example downhole fluid analyzers 400, 600, 700, 800 may be used. For example, the order of execution of the blocks may be changed, and/or some of the blocks described may be changed, eliminated, or combined.

As mentioned above, the example processes of FIGS. 9-10 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Furthermore, the example processes of FIGS. 9-10 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

An example process 900 that may be executed to implement one or more of the example downhole fluid analyzers 400, 600, 700, 800 of FIGS. 4-8 is illustrated in FIG. 9. The process 900 begins execution at block 905 where light is emitted from a light source, such as the light device(s) 430, 435 and/or the laser scanner 805, toward a formation fluid to be measured. For example, the light device(s) 430, 435 and/or the laser scanner 805 emit light that is to contact (e.g., pass-through and/or be reflected by) the formation fluid 410 being analyzed.

At block 910, a depressurizer, such as the depressurizer 455, depressurizes the formation fluid 410 to draw out the gas (e.g., via bubble nucleation) from the formation fluid 410. In some examples, bubble nucleation is facilitated with geometric restrictions, agitators, and/or localized heat pulses. At block 915, the depressurizer (e.g., the depressurizer 455) stores pressure and temperature data (e.g., from the pressure and temperature gauge(s) 465) during the depressurization of the formation fluid 410 for retrieval by a controller (e.g., the controller 420). For example, as the formation fluid 410 is depressurized, the depressurizer 455 may timestamp the pressure and temperature data.

At block 920, while the formation fluid 410 is being depressurized, an imaging processor (e.g., the downhole imaging processor 405 and/or 815) captures and processes imaging data based on the light emitted at block 905 that contacts the formation fluid 410. At block 925, the imaging processor (e.g., the downhole imaging processor 405 and/or 815) stores the processed imaging data for retrieval by the controller (e.g., the controller 420) of the downhole fluid analyzer. In some examples, the processed imaging data is timestamped to associate the processed imaging data with the pressure and temperature data stored at block 915.

At block 930, a controller (e.g., the controller 420) retrieves the pressure and temperature data recorded by the depressurizer (e.g., the depressurizer 455) and the processed imaging data determined by the imaging processor (e.g., the downhole imaging processor 405 and/or 815) for post-processing to determine downhole measurement data for reporting to the surface. For example, the controller 420 can process timestamped object boundary imaging data determined by the imaging processor 405 and/or 815 to determine fluid analysis measurement data including the bubble point and/or the asphaltene onset pressure. Further, in some examples, the controller (e.g., the controller 420) can perform post-processing to calculate the gas-to-oil ratio (GOR) of the formation fluid. The controller can also format the resulting measurement data for transmission via a telemetry communication link (e.g., the telemetry communication link 425), as described above. At block 935, the controller (e.g., the controller 420) reports the measurement data determined at block 930 to the surface (e.g., to the logging and control unit 140) via the telemetry communication link (e.g., the telemetry communication link 425) after which the example process of FIG. 9 ends.

An example process 930 that can be used to implement the processing at block 930 of FIG. 9 and/or post-processing in a controller (e.g., the controller 420) is illustrated in FIG. 10. With reference to the preceding figures and associated descriptions, the process 930 of FIG. 10 begins execution at block 1005 at which the controller (e.g., the controller 420) processes the pressure and temperature data obtained from a depressurizer (e.g., the depressurizer 455) and the processed imaging data obtained from an imaging processor (e.g., the downhole imaging processor 405 and/or 815) to determine the asphaltene onset pressure of the formation fluid 410. For example, the controller 420 identifies the point in time when an initial increase in asphaltenes 510 in the formation fluid 410 is observed in the processed imaging data and matches that time (based on a timestamp) to the corresponding pressure and temperature data, as described above.

At block 1010, the controller (e.g., the controller 420) processes the pressure and temperature data obtained from the depressurizer (e.g., the depressurizer 455) and the processed imaging data obtained from the downhole imaging processor (e.g., the downhole imaging processor 405 and/or 815) to determine the bubble point of the formation fluid 410. For example, the controller 420 identifies the point in time when most of the bubbles 505 in the formation fluid 410 appear and matches that time (based on a timestamp) to the corresponding pressure and temperature data, as described above.

At block 1015, the controller (e.g., the controller 420) processes the pressure and temperature data obtained from the depressurizer and the processed imaging data obtained from the downhole imaging processor to calculate the gas-to-oil ratio (GOR) of the formation fluid 410. In some examples, the controller calculates the GOR of the formation fluid 410 based on the processed imaging data corresponding to a period during the depressurization of the formation fluid 410 when the gas (e.g., the bubbles 505) has been drawn out of the formation fluid 410. In some examples, the controller 420 processes the imaging data corresponding to a threshold amount of time after the detected bubble point during which no additional bubbles 505 are detected. In other examples, the controller may process the imaging data corresponding to a pressure of the formation fluid 410 that is lower than the pressure corresponding to the detected bubble point by a threshold. With the processed imaging data associated with the gas having been withdrawn out of the formation fluid 410, the controller 420 determines the area of bubbles 505 detected in a capillary tube (e.g., the capillary tube 415) and sums the areas up as described in equation 1. To implement the example downhole fluid analyzer 700 of FIG. 7, rather than using the area, the controller 420 calculates the respective volumes of bubbles 505 and sums volumes as described above. To implement the example downhole fluid analyzer 800 of FIG. 8, the controller 420 calculates the areas of the respective cross-sectional segments 830 of the bubbles 505 and sums the cross-sectional segments 830 for inclusion in equation 3, as described above. Once the GOR of the formation fluid 410 has been calculated, the example process of FIG. 10 ends.

Figure 11:
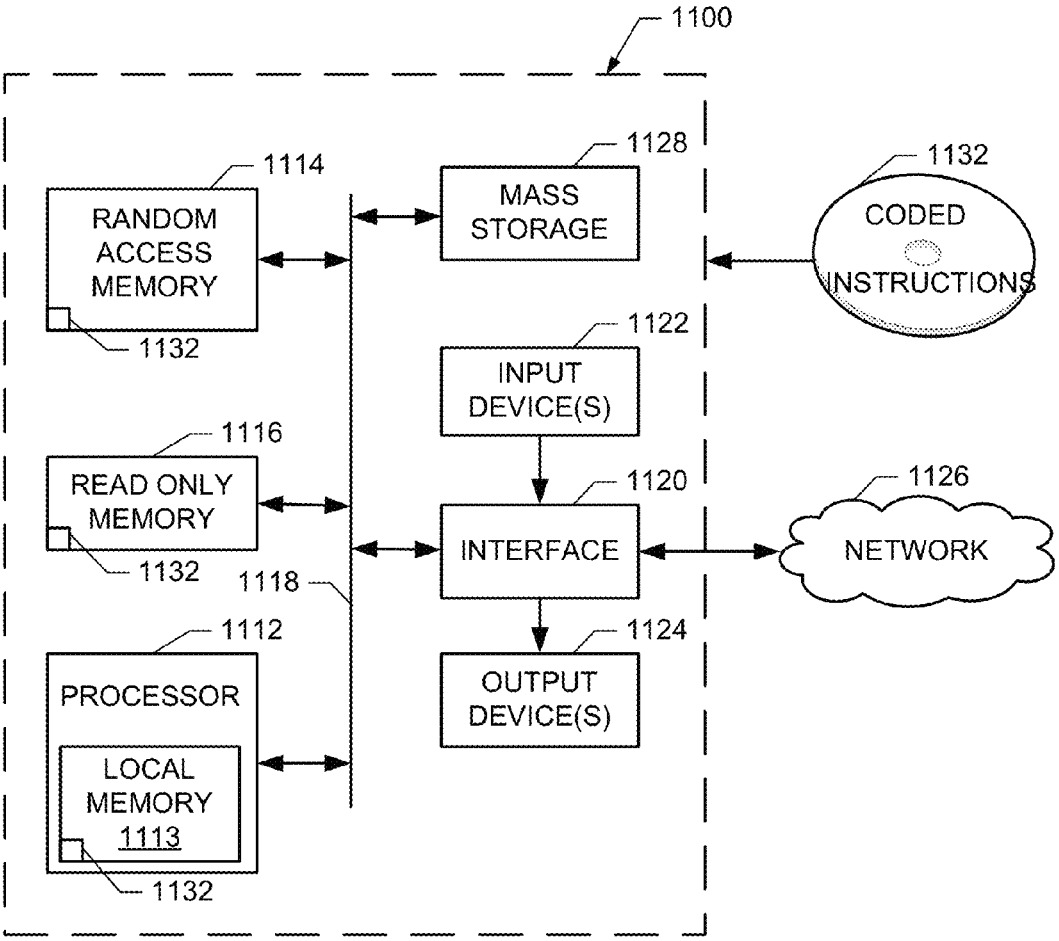
FIG. 11 is a block diagram of an example processing system that may execute example machine readable instructions used to implement one or more of the processes of FIGS. 9 and/or 10 to implement the example downhole fluid analyzers of FIGS. 4, 5, 6, 7, and/or 8.

FIG. 11 is a block diagram of an example processor platform 1100 capable of executing the instructions of FIGS. 9-10 to implement the example downhole fluid analyzers 400, 600, 700, 800 of FIGS. 4-8. The processor platform 1100 can be, for example, a smart controller, a special purpose computing device, a server, a personal computer, a mobile device (e.g., a cell phone, a smart phone, a tablet such as an iPad™), a personal digital assistant (PDA), an Internet appliance, or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors or controllers from any desired family or manufacturer.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. The interface circuit 1120 may be implemented by any type of interface standard, such as an Ethernet interface, a universal serial bus (USB), and/or a PCI express interface.

In the illustrated example, one or more input devices 1122 are connected to the interface circuit 1120. The input device(s) 1122 permit(s) a user to enter data and commands into the processor 1112. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1124 are also connected to the interface circuit 1120 of the illustrated example. The output devices 1124 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1120 of the illustrated example, thus, typically includes a graphics driver card, a graphics driver chip or a graphics driver processor.

The interface circuit 1120 of the illustrated example also includes a communication device such as a transmitter, a receiver, a transceiver, a modem and/or network interface card to facilitate exchange of data with external machines (e.g., computing devices of any kind) via a network 1126 (e.g., an Ethernet connection, a digital subscriber line (DSL), a telephone line, coaxial cable, a cellular telephone system, etc.).

The processor platform 1100 of the illustrated example also includes one or more mass storage devices 1128 for storing software and/or data. Examples of such mass storage devices 1128 include floppy disk drives, hard drive disks, compact disk drives, Blu-ray disk drives, RAID systems, and digital versatile disk (DVD) drives.

The coded instructions 1132 of FIGS. 9-10 may be stored in the mass storage device 1128, in the volatile memory 1114, in the non-volatile memory 1116, and/or on a removable tangible computer readable storage medium such as a CD or DVD.

Instead of implementing the methods and/or apparatus described herein in a system such as the processing system of FIG. 11, the methods and or apparatus described herein may be embedded in a structure such as a processor and/or an ASIC (application specific integrated circuit).

Although a few example embodiments have been described in detail above, those skilled in the art will readily appreciate that many modifications are possible in the example embodiments without materially departing from the scope of this disclosure. Accordingly, such modifications are intended to be included within the scope of this disclosure as defined in the following claims. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Finally, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A system to perform downhole fluid analysis, the system comprising:

a depressurizer to be positioned down hole in a geological formation to depressurize a formation fluid in the geological formation, the depressurization of the formation fluid to cause bubbles to nucleate in the formation fluid;

an imaging processor to be positioned downhole in the geological formation, the imaging processor to capture imaging data associated with the formation fluid, to process the imaging data downhole, and to detect nucleation of the bubbles in the formation fluid based on the imaging data;

a capillary tube to hold the formation fluid while the imaging data is captured;

a controller to report measurement data via a telemetry communication link to a receiver to be located outside the geological formation, the measurement data including a bubble point of the formation fluid calculated based on the detected nucleation of the bubbles; and a laser scanner to generate at least two separate 2D laser sheets sequentially, each at a different depth, across the formation fluid for contact with the bubbles present at each of the different depths within the formation fluid, the captured imaging data including at least two separate 2D image planes corresponding to the at least two separate 2D laser sheets, wherein the measurement data includes a gas-to-oil ratio of the formation fluid, the gas-to-oil ratio based on a ratio of a volume of the bubbles in the formation fluid to a volume of the formation fluid, the volume of the bubbles determined based on a summation of areas of the bubbles along a length of the capillary tube indicated in the imaging data.

2. The system of claim 1, wherein a diameter of the capillary tube is less than a diameter of the bubbles to separate the bubbles from the formation fluid along a length of the capillary tube.

3. The system of claim 1, wherein the 2D image planes identify cross-sectional areas of the bubbles at the different depths within the formation fluid.

4. The system of claim 3, wherein the measurement data includes a gas-to-oil ratio of the formation fluid, the gas-to-oil ratio being based on a ratio of a volume of the bubbles in the formation fluid to a volume of the formation fluid, the volume of the bubbles being based on a summation of the cross-sectional areas of the bubbles at the different depths.

5. The system of claim 1, wherein the imaging processor is to distinguish between the bubbles and asphaltenes in the formation fluid based on at least one of (1) an intensity of the captured imaging data associated with the bubbles and the asphaltenes or (2) a shape of the bubbles and the asphaltenes.

6. The system of claim 5, wherein the measurement data includes multiphase flow rate measurements indicative of at least two of (1) a flow rate of the bubbles, (2) a flow rate of the asphaltenes, or (3) a flow rate of the formation fluid.

7. The system of claim 1, wherein the imaging processor is to detect asphaltenes in the formation fluid, the measurement data to include an asphaltene onset pressure of the formation fluid based on the detected asphaltenes.

8. The system of claim 1, wherein the imaging processor is sensitive to near-infrared light to analyze the formation fluid when the formation fluid is opaque.

9. A method for performing downhole fluid analysis, the method comprising:

capturing, via an imaging processor positioned downhole in a geological formation, imaging data associated with a formation fluid in the geological formation, the formation fluid comprising gas and oil;

processing the imaging data downhole to detect bubbles of the gas in the formation fluid;

scanning across the formation fluid with at least two separate 2D laser sheets sequentially, each at a different depth for contact with the bubbles present at each different depths within the formation fluid, the imaging data corresponding to at least two separate 2D image planes for the different depths when the formation fluid is scanned with the at least two separate 2D laser sheets, wherein the areas of the bubbles present correspond to cross-sectional segments within the at least two separate 2D image planes for the different depths within the formation fluid;

calculating a gas-to-oil ratio of the formation fluid based on a ratio of a volume of the bubbles to a volume of the oil in the formation fluid, the volume of the bubbles being based on a summation of areas of the bubbles detected in the imaging data; and sending measurement data via a telemetry communication link to a receiver located outside the geological formation, the measurement data including the gas-to-oil ratio.

10. The method of claim 9, further comprising: depressurizing the formation fluid to nucleate the bubbles in the formation fluid; and determining a bubble point of the formation fluid based on detecting the nucleation of the bubbles.

11. The method of claim 9, further comprising: depressurizing the formation fluid to cause asphaltenes to precipitate in the formation fluid; processing the imaging data to detect the precipitated asphaltenes; and determining an asphaltene onset pressure of the formation fluid based on the detected precipitated asphaltenes.

12. The method of claim 9, further comprising passing the formation fluid through a capillary tube while capturing the imaging data, a diameter of the capillary tube being less than a diameter of the bubbles to reduce overlap of the bubbles and the oil in a line-of-sight of the imaging processor.

13. A system to perform fluid analysis, the system comprising:

a high-speed imaging processor to capture imaging data associated with a sample of formation fluid from a geological formation and to process the imaging data to detect bubbles in the sample of the formation fluid;

a laser scanner to emit at least two separate 2D laser sheets sequentially, each at a different depth across the sample of the formation fluid within the sample of the formation fluid, the high-speed imaging processor to capture respective, separate 2D imaging data at each of the different depths as each of the at least two separate 2D laser sheets are emitted for contact with the bubbles present; and a controller to generate measurement data associated with the formation fluid in substantially real-time, the measurement data including a gas-to-oil ratio of the formation fluid based on a ratio of a volume of the bubbles to a difference of a total volume of the sample and the volume of the detected bubbles, the volume of the bubbles being based on a summation of areas in the imaging data associated with the bubbles.

14. The system of claim 13, further comprising: a depressurizer to depressurize the sample of the formation fluid to cause the bubbles to nucleate in the formation fluid; and a pressure gauge to monitor a pressure of the formation fluid as the formation fluid is depressurized.

15. The system of claim 13, further comprising a capillary tube to hold the sample of the formation fluid, the capillary tube having a diameter smaller than a diameter of the bubbles.

* * * * *